United States Patent [19]

Porter

[11] Patent Number: 4,475,309

[45] Date of Patent: Oct. 9, 1984

[54] MODULAR PROTECTIVE GRILL

[75] Inventor: Harvey Porter, Narberth, Pa.

[73] Assignee: Royal Factories, Incorporated, Philadelphia, Pa.

[21] Appl. No.: 390,917

[22] Filed: Jun. 22, 1982

[51] Int. Cl.[3] ..... E06B 3/68

[52] U.S. Cl. ..... 49/55; 49/193

[58] Field of Search ..... 49/55, 50, 193; 52/656, 52/507; 160/206

[56] References Cited

U.S. PATENT DOCUMENTS

| | | | |
|---|---|---|---|
| 2,310,539 | 2/1943 | Nelson et al. | 49/55 X |
| 3,054,447 | 9/1962 | Brydolf | 160/206 |
| 4,026,070 | 5/1977 | Hicks | 49/55 |
| 4,394,805 | 7/1983 | Napper | 49/55 |

*Primary Examiner*—Kenneth Downey

*Attorney, Agent, or Firm*—Karl L. Spivak

[57] ABSTRACT

A modular protective grill is disclosed for removably overfitting a building opening, such as a window. The grill includes a decorative central body which terminates vertically in an upper tubular frame member and a lower tubular frame member. Tubular side attachment bars are affixed to the window jambs and upwardly and downwardly carry telescoping vertical frame extensions. Horizontal frame extensions telescope within the lateral ends of the upper and lower tubular frame members and respectively carry vertical pivot pins. The pivot pins insert into the free ends of the vertical frame extensions to allow the central body to pivot about either side attachment bar by disconnecting the opposite side. The protective grill includes tamper-proof break-away construction members to permit emergency egress upon opening a side of the grill construction.

20 Claims, 6 Drawing Figures

MODULAR PROTECTIVE GRILL

BACKGROUND OF THE INVENTION

The present invention relates generally to the field of building protection devices, and more particularly, is directed to an adjustable, modular window guard suitable for installation over an existing window construction.

The need to protect buildings from unwanted intruders has always existed and great numbers of building protective devices have been designed and installed by prior workers in the art. Of particular interest has been the protection of window openings, which openings have traditionally formed an easy access means into the building for would-be thieves.

The protection of window openings in the past has proceeded along two general approaches. One is to provide stronger and better locking features for the window sash and the other is to furnish and install a separate guard or protective device to restrict access to the sash itself. The present invention is concerned with this latter approach. In order to make such protective devices usable with windows of various sizes, most prior window guards have included telescoping parts to readily adjust to the lateral or vertical window opening dimensions. While such construction features were successful to solve the problem of installation size adjustment, the interlocking, mating parts required rather precise manufacturing standards in order to assure the capability of sliding one part relative to the other. This increased production costs, both because of the greater care in manufacturing that was required and because of the relatively high rate of rejection of improperly made parts.

The telescoping construction of many prior art grills, by its very nature, required the interacting parts to be linear in configuration so that one part could slide relative to the other. This feature resulted in a bar-like or prison-like effect in the completed design, a configuration that was not particularly acceptable in and about a residential property. Additionally, most prior art grills had to be rigidly and permanently affixed in the window opening, thereby effectively preventing any future use of the window as an emergency means of egress in the event of fire or other unwanted occurrence. In those instances wherein the protective grill was designed to be operable, most often a hasp and lock arrangement was employed for this purpose. These very locking features often proved to be the weakest part of the protective construction and were most often subject to direct attack by an intruder.

SUMMARY OF THE INVENTION

The present invention relates generally to the field of metallic protective grills for windows, and more particularly, is directed to a modular, steel protective grill including adjustable features to facilitate easy installation.

The protective grill of the present invention incorporates a central, decorative grill body which affixes to upper and lower, laterally extending, hollow, tubular frame members. The upper and lower frame members are vertically spaced apart a selected distance, for example a distance equaling the height of the window opening or the height of a window sash. Preferably, the central grill body may be fabricated in any one of a number of aesthetically pleasing designs to thereby render the grill construction generally attractive to a great number of homeowners with varying aesthetic tastes.

Spaced pairs of upper and lower horizontal frame extensions are telescopingly received within the respective left and right ends of the upper and lower tubular frame members for easy lateral adjustment to the exact width of the window opening to be protected. The horizontal frame extensions each terminate endwardly in a vertically bent hinge rod for hinged engagement within the ends of respective pairs of vertical frame extensions. The horizontal frame extensions include adjustment means to lock the various connected parts in the desired laterally adjusted position.

Left and right side attachment bars are fabricated similarly to the upper and lower frame bars and are formed to a hollow, rectangular configuration. Respective pairs of spaced, upper and lower vertical frame extensions are telescopingly received within the respective upper and lower ends of the left and right attachment bars. The vertical frame extensions are similarly formed to a hollow, rectangular configuration and are sized to receive therein the projecting vertical portions of the adjacent hinge rods carried by the horizontal frame extensions. The grill construction may be pivoted about either the left attachment bar or the right attachment bar by disengaging the hinge rods at the opposite side. The vertical frame extensions include adjustment means to lock the various connected parts in the desired vertically adjusted position.

It is an important feature of the present invention to provide sufficient openings in each side attachment bar in offset relationship to each other for universal mounting application. Accordingly, the same side attachment bars may be secured in a one orientation to the insides of the window jambs if such an installation is desirable for a flush installation or to portions of the building construction adjacent to the window opening if a surface mounted installation is desired. The pairs of openings include fastener receiver openings of size to allow the fastener head to pass therethrough so that the fasteners themselves will be protected and hidden from sight within the interior of the hollow tubular attachment bars. Preferably, the fasteners employed for securing the grill in and about the window construction are of the so-called tamper-proof design. That is, once the fasteners have been securely positioned in place, special tools or special procedures will be required to remove them. Thus, once the grill of the present invention has been securely installed to protect a window opening, easy removal for unauthorized entrance will thereby be discouraged.

Preferably, the fasteners employed in adjusting the various frame extensions within the frame bars to fit the particular dimensions of an individual window opening will face inwardly so that the occupants of the house can have ready access to the fasteners. Accordingly, by employing fasteners having special designed heads with tamper-proof sockets and by storing a suitable socket wrench within the building in the vicinity of the opening, the resident seeking emergency egress through the window can readily employ the special tool to remove one or more of the threaded fasteners to thereby allow escape through the window opening. Also, by positioning the fasteners to face inwardly, easy access and visual observance by a would-be thief will additionally be discouraged.

It is therefore an object of the present invention to provide an improved protective grill of the type set forth.

It is another object of the present invention to provide a novel modular protective grill featuring easy length and height adjustment means and incorporating a break-away feature to permit emergency egress through an opening protected by the grill.

It is another object of the present invention to provide a novel protective grill including a central, decorative, aesthetically pleasing grill body and vertically and horizontally adjustable means to support the body within a window opening.

It is another object of the present invention to provide a novel modular protective grill which comprises a central, aesthetically pleasing grill body, means to permit portions of the grill to be broken away for emergency egress and which includes no type of hasp or padlock for breakaway purposes.

It is another object of the present invention to provide a novel modular protective grill that comprises a central grill body, horizontally adjustable means to adjust the horizontal dimension of the grill to the width of a window opening whereby the overall dimensions of the grill maybe readily adjusted on the site to meet existing width dimensions of a window opening.

It is another object of the present invention to provide a novel modular protective grill which includes construction members that can be readily assembled without close tolerances whereby manufacturing procedures can be facilitated.

It is another object of the present invention to provide a novel modular protective grill that is attractive in appearance, inexpensive in manufacture and readily adjustable for installation.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
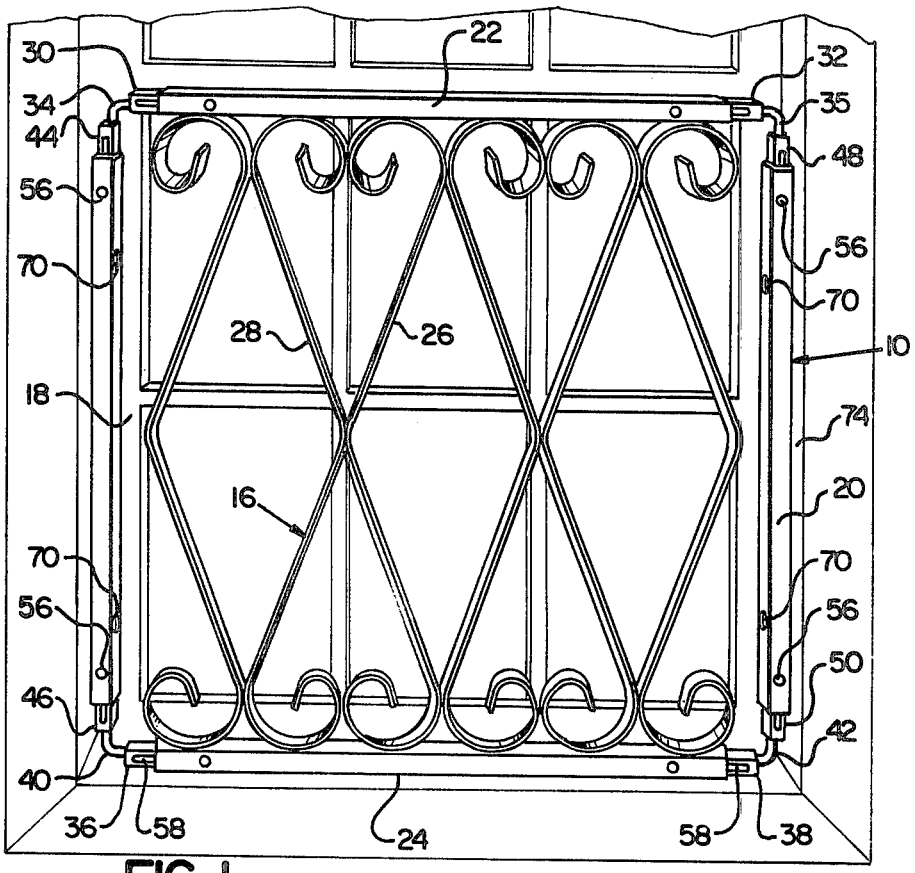
FIG. 1 is a front perspective view of the protective grill of the present invention installed within a window opening.

Although specific terms are used in the following description for the sake of clarity, these terms are intended to refer only to the particular structure of the invention selected for illustration in the drawings, and are not intended to define or limit the scope of the invention.

Figure 2:
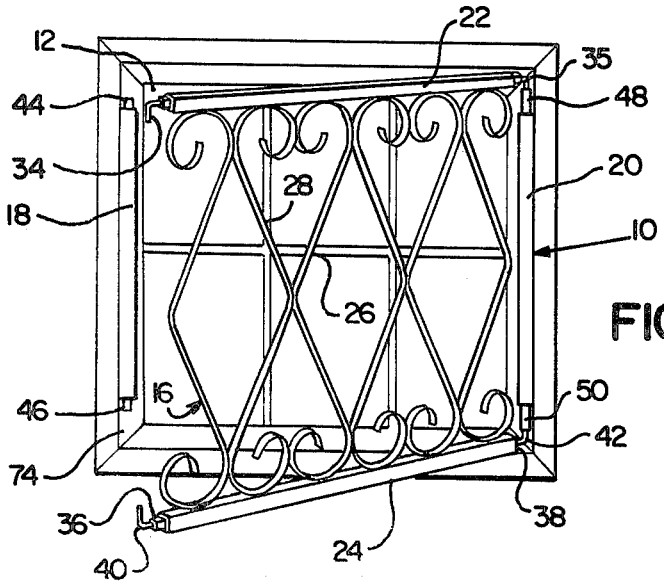
FIG. 2 is a front perspective view similar to FIG. 1 showing the protective grill in a break-away position.

Referring now to the drawings, there is illustrated in FIGS. 1 and 2 a break-away grill generally designated 10 which is fabricated of strong, bent steel and tube construction and which is suitably welded or otherwise interconnected to form a shield over a window or other building opening 12 for the protection thereof. The grill includes a central, aesthetically pleasing, sturdily designed body 16 which preferably is manufactured in modular sizes to fit window openings of various dimensions. For example, the central body 16 may come in standard widths of six inch increments in size, such as twenty inches, twenty-six inches, and thirty-two inches. Side attachment bars 18, 20 and a plurality of frame extensions 30, 32, 36, 38 provide up to three inches adjustment on each side whereby a six inch width adjustment can readily be achieved with the construction of the present invention. Additionally, by providing width adjustment on each side of the central body 16, a balanced final installation within the building opening 12 can be easily made.

The grill central body 16 further comprises an upper main guard frame member 22 and a lower main guard frame member 24, which members are secured to the various bent decorative grill members 26, 28 at the upper and lower termini thereof, for example by welding. Each of the side attachment bars 18, 20 and the upper and lower main guard frame members 22, 24 are similarly constructed of hollow steel tubes that are preferably rectangular or square in cross-sectional configuration.

Each end of the upper horizontal main guard frame member 22 telescopingly receives a respective horizontal frame extension 30, 32, which frame extensions are configured to slide within and be retained within the opening defined at each end of the frame member 22. Similarly, each end of the lower horizontal main guard frame member 24 telescopingly receives a respective lower horizontal frame extension 36, 38, which frame extensions are configured to slide within and be retained within the end openings defined at each end of the lower main frame member 24.

Figures 3, 4, 5, 6:
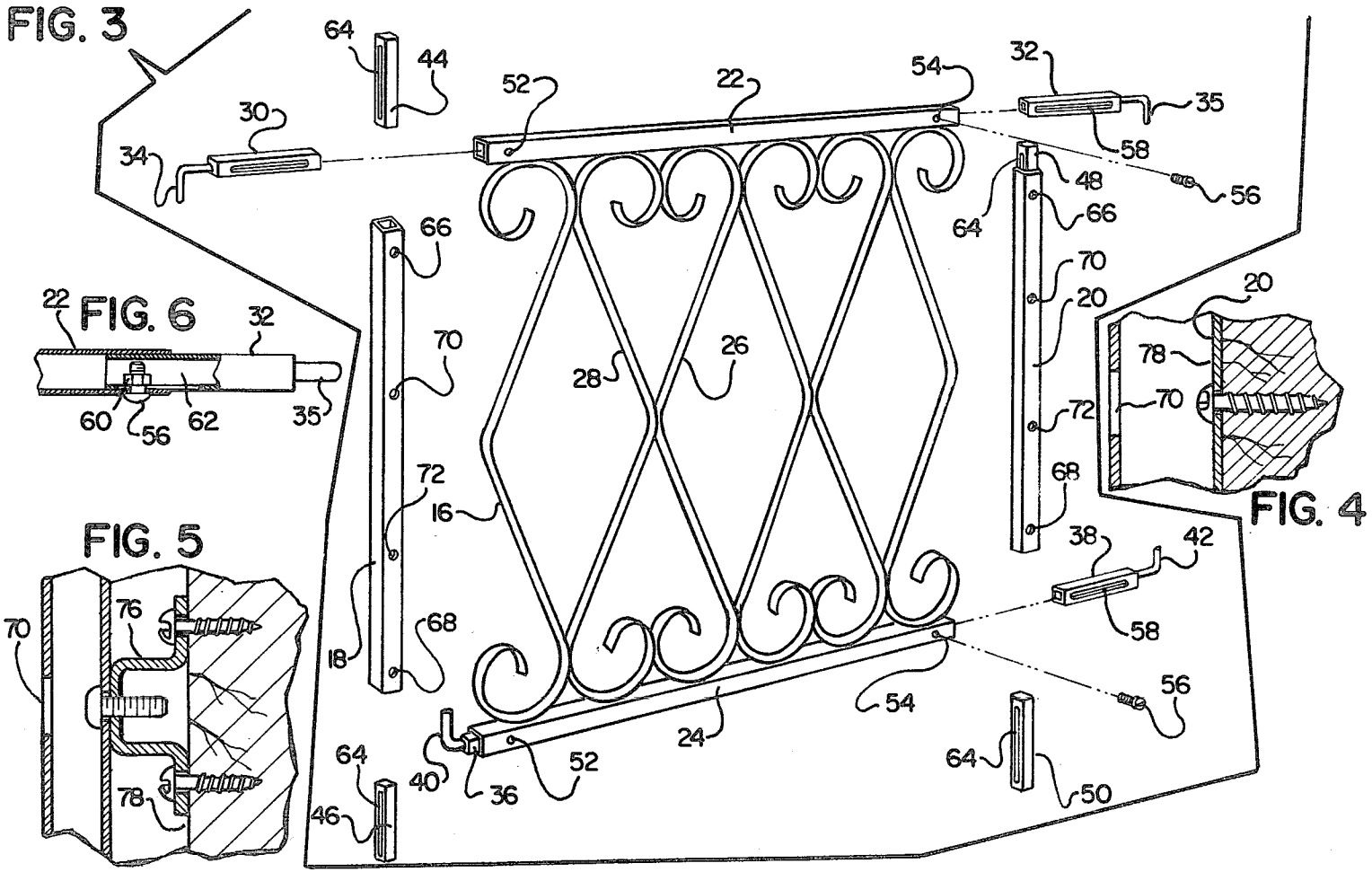
FIG. 3 is an exploded, perspective view showing the construction members of the grill.
FIG. 4 is an enlarged, detail, perspective view showing a jamb mounting construction.
FIG. 5 is an enlarged, perspective, detail view showing an offset bracket for exposed grill mounting.
FIG. 6 is an enlarged, perspective, detail view of the length and height adjusting mechanism.

As best seen in FIG. 3, the horizontal frame extensions 30, 32 each terminate laterally outwardly in an integral, downwardly depending, hinge rod or pin 34, 35, the purpose of which pins will hereinafter be more fully set forth. Similarly, the lower horizontal frame extensions 36, 38 are in telescoping engagement within the hollow ends of the lower main guard frame member 24 and are similarly equipped with a laterally outwardly positioned hinge rod or pin 40, 42. As illustrated, the rods or pins 40, 42 face upwardly toward the upwardly positioned hinge rods 34, 35.

Still referring to FIG. 3, it will be observed that the left and right side attachment bars 18, 20 are equipped with vertically spaced pairs of upper and lower vertical frame extensions 44, 46 and 48, 50. The upper and lower vertical frame extensions are fabricated of hollow, rectangular configuration of size to be slidingly received within the left and right side extension bars 18, 20 and are formed of hollow, tubular construction. The hollow interior of the left pair of vertical frame extensions 44, 46 are sized to respectively receive therein the left pair of hinge pins or rods 34, 40. Similarly, the hollow interiors of the right pair of upper and lower vertical frame extensions 48, 50 are sized to respectively receive therein the upper and lower right pair of hinge pins 35, 42. As illustrated in FIG. 2, the central body 16 may be pivoted about either the left or right side attachment bar 18, 20 simply by disassociating one pair of upper and lower hinge pins 34, 40 (or 35, 42) from their respective associated vertical frame extensions 44, 46 (or 48, 50).

The upper and lower main frame members 22, 24 are each provided with laterally positioned openings 52, 54 to receive therethrough a tamper-proof type of fastener 56 for securing the upper pair of frame extensions 30, 32 and the lower pair of frame extensions 36, 38 in a properly telescoped position for the required lateral adjustment to fit the width of any window opening construction 12. As above set forth, the frame extensions 30, 32 and 36, 38 are telescopingly received within the respective ends of the frame members 22, 24 to facilitate lateral width adjustment. Also, the width of the central body 16 is modular in design and is formed in six inch increments to thus accommodate substantially all common window constructions.

Referring now to FIGS. 3 and 6, it will be observed that each frame extension 30, 32, 36, 38 is provided with an adjusting slot 58 for securing the frame extension within a respective frame member 22, 24 in a desired, lateral adjusted position. Referring particularly to FIG. 6, it will be noted that a threaded nut 60 is slidingly retained within each interior space 62 defined within the various extensions 30, 32, 36, 38 in a manner to permit relative longitudinal movement therewithin without rotation. Accordingly in order to engage the various frame extensions 30, 32, 36, 38 within the interior of the upper and lower frame members 22, 24 and to lock them in a desired, laterally adjusted position, the frame extensions should first be inserted endwardly partially into the interior of the frame members 22, 24 until the threaded nut 60 aligns with one of the openings 52, 54 which are provided therefor. With the openings 52, 54 aligned in front of a threaded nut 60, a tamper-proof fastener 56 can then be inserted through an opening 52, 54 and threadedly engaged upon the nut. The frame extensions can then be telescopingly adjusted relative to the frame members 22, 24 until the desired overall width is achieved. Once this width has been determined, the fasteners 56 can then be tightened within in the respective nuts 60 to lock the frame extensions in position and laterally secure the overall width dimensions of the grill 10.

In a similar manner, as illustrated in FIGS. 1, 3 and 6, the left and right side attachment bars 18, 20 are each provided with upper and lower spaced openings 66, 68 to easily receive a tamper proof fastener 56 therethrough. As illustrated in FIG. 3, the respective pairs of upper and lower vertical frame extensions 44, 46 and 48, 50 are each provided with a longitudinally extending adjusting slot 64 to provide for vertical adjustment of the grill 10 to suit a variety of different size window opening heights. In a manner similar to that described for the horizontal frame extensions, a similar threaded nut 60 is retained within the hollow interior of the various vertical frame extensions in sliding adjustment in registry behind each adjusting slot 64. As above set forth, the nut is fabricated of size to longitudinally slide within the frame extensions but in a manner to prevent rotation therewithin.

In order to provide a break-away type of construction, the vertical frame extensions 44, 46, 48, 50 are slidingly received within the hollow interiors of the left and right side attachment bars 18, 20 and can be secured in a desired, locked orientation by respectively positioning the threaded nuts 60 behind the upper and lower openings 66, 68. Then by engaging a tamper-proof fastener 56 through the aligned slots 64 and openings 66, 68, the various vertical frame extensions can be locked in a desired vertically adjusted position.

As best seen in FIG. 3 and FIG. 5, the side attachment bars 18, 20 are provided with respective upper and lower attaching openings 70, 72 for securing either directly to the window jambs 74 when a flush mount is desired or to a bracket 76 for use in affixing the grill 10 to the outer or inner face 78 of the building wall.

In order to use the protective grill 10 of the present invention, the window opening 12 to be protected should be measured to determine the closest modular size central body 16 that can be utilized with that particular size window. Next, the side attachment bars 18, 20 should be secured in the proper position either directly against the window jambs 74 or against the face 78 of the building wall by employing suitable brackets 76 as illustrated in FIG. 5. It is noteworthy that the side attachment bars may be turned for either surface mounting as in FIG. 5 or for recessed mounting as illustrated in FIG. 4 and the same attaching openings 70, 72 can be employed. The various frame extensions 44, 46, 48 and 50 can then be loosely placed in position and secured within the side attachment bars 18, 20 by using suitable tamper proof fasteners 56. The use of the slots 64 prevents inadvertent disassociation or dropping of the frame extensions during the installation procedures.

Next, the various horizontal frame extensions 30, 32, 36, 48 can be secured to the lateral ends of the upper and lower main guard frame members 22, 24, centered in position and then secured by tightening the tamper proof fasteners 56. The various upper and lower hinge rods 34, 35 and 40, 42 are inserted into the respective adjacent hollow ends of the upper and lower vertical frame extensions 44, 46, 48, 50 prior to tightening. The vertical frame extensions should then be extended as far as possible both upwardly and downwardly and the various tamper-proof fasteners should then be tightened to provide a tight, unified construction which will be secured in position in a manner to prevent rattling and to provide a solid, tight, protective feel.

In order to open the grill 10 for cleaning or for emergency exit, the tamper proof screws or fasteners 56 applied in one of the side bars 18 or 20 to secure a pair of vertical frame extensions 44, 46 or 48, 50 should be loosened to allow either the left pair of vertically aligned pins 34, 40 or the right pair of vertically aligned pins 35, 42 to be freed from association with their respective vertical frame extensions. This allows the grill body 16 to break away and horizontally pivot or swing about the opposite pair of still retained pins 34, 40 or 35, 42. See FIG. 2. To again relock the grill construction, the released set of hinge rods or pins 40, 42 or 34, 35 should then be reaffixed within their respective associated vertical frame extensions and the frame extensions adjusted and secured in position.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A protective grill for overfitting a building opening having a height and a width defined between a left jamb and a right jamb comprising a central body overfitting a major portion of the building opening, the body being provided with upper and lower tubular means to adjust the width of the grill, the upper and lower tubular members each having left and right ends;

side attachment bar means secured to each jamb to affix a portion of the central body to the jamb;

horizontal adjustable means in sliding engagement within at least some of the left and right ends and interconnected between the upper and lower tubular means of the central body and the side attachment bar means to permit horizontal adjustment therebetween;

fasteners engaged in the horizontal adjustable means to secure the horizontal adjustable means to the central body upper and lower tubular means in any one of a plurality of laterally adjusted positions; and hinge pins means carried by the horizontal adjustable means to pviotally interconnect the lateral ends of the central body respectively to the side attachment bar means.

2. The grill of claim 1 wherein the central body comprises a plurality of grill bars, an upper frame member secured upwardly to the grill bars and a lower frame member secured downwardly to the grill bars.

3. The grill of claim 2 wherein at least one of the upper and lower frame members is tubular and defines a hollow end.

4. The grill of claim 3 wherein a portion of the adjustable means is adjustably positioned within the said hollow end.

5. The grill of claim 1 wherein the horizontal adjustable means is provided with an elongated opening, and wherein the said left and right ends are provided with openings positioned to align with the elongated opening and a fastener means positioned through the aligned openings to secure the portion of the horizontal adjustable means to an upper and lower tubular means.

6. The grill of claim 5 wherein the fastener means comprises a threaded fastener and a nut, the nut being positioned within the elongated opening portion of the horizontal adjustable means in a non-rotatable manner.

7. The grill of claim 6 wherein the fastener comprises a tamper-proof head.

8. The grill of claim 6 or claim 7 wherein one of the said openings comprises an elongated slot.

9. The grill of claim 6 wherein the nut is adapted for sliding movement within the elongated opening portion of the horizontal adjustable means.

10. The grill of claim 6 or claim 7 wherein the nut is adapted for sliding movement within the said portion of the adjustable means without rotation.

11. The grill of claim 1 wherein the side attachment bar means upper and lower ends, and vertical adjustment means in sliding engagement within at least some of the upper and lower ends, and wherein the hinge pin means pivotally interconnect with the vertical adjustment means.

12. The grill of claim 11 and break-away means between the side attachment bar means and central body to disconnect the said ends of the tubular members from the side attachment bar means, the break away means comprising elongated openings in the vertical adjustment means and openings provided in the side attachment bar means positioned to align with the elongated openings and second fastener means positioned through the aligned openings to either secure or release the vertical adjustment means relative to the upper and lower ends of the side attachment bar means.

13. The grill bar of claim 12 wherein the break-away means comprises a tamper-proof fastener.

14. A protective window grill comprising a central body comprising a plurality of interconnected grill bars;

upper and lower frame members horizontally connected to respective upper and lower portions of the grill bars;

a horizontal frame extension in telescoping relation to at least one end of the upper and lower frame members to permit horizontal width adjustment;

left and right side attachment bars rearwardly connected to the upper and lower frame members to permit the central body to pivot relative to a side attachment bar;

a vertical frame extension in telescoping relation to at least one end of the left and right side members to permit vertical height adjustment;

pin means intermediate the horizontal frame members and the vertical side attachment bars to permit the central body to pivot about a side attachment bar; and break-away means intermediate the horizontal frame members and the vertical side attachment bars to disconnect portions of the frame members from portions of the side attachment bars.

15. The protective grill of claim 14 wherein the pin means is connected to at least one of the horizontal frame extensions.

16. The protective grill of claim 15 wherein the pin means is vertically oriented.

17. The protective grill of claim 16 wherein the ends of the side attachment bars are hollow and wherein the pin means positions within a said hollow end.

18. The protective grill of claim 14 wherein the break-away means comprises a tamper-proof fastener.

19. The protective grill of claim 14 and tamper-proof means to lock the vertical frame extensions within the said side members.

20. The protective grill of claim 14 or claim 19 and tamper-proof means to lock the horizontal frame extensions within the said frame members.

* * * * *